United States Patent [19]

Yamai et al.

[11] Patent Number: 4,689,728

[45] **Date of Patent: * Aug. 25, 1987**

[54] LAMP ASSEMBLY

[75] Inventors: Yoshihiro Yamai; Hideo Hamamoto; Masami Nishibe, all of Toyota, Japan

[73] Assignee: Toyota Jidosha Kabushiki Kaisha, Japan

[ * ] Notice: The portion of the term of this patent subsequent to Sep. 17, 2002 has been disclaimed.

[21] Appl. No.: 808,682

[22] Filed: Dec. 16, 1985

Related U.S. Application Data

[63] Continuation of Ser. No. 573,655, Jan. 25, 1984, abandoned.

[30] Foreign Application Priority Data

Jan. 27, 1983 [JP] Japan ..... 58-11654

[51] Int. Cl.[4] ..... F21V 5/00

[52] U.S. Cl. ..... 362/268; 362/311; 362/331; 362/335; 362/339; 362/351; 362/375

[58] Field of Search ..... 362/61, 293, 268, 331, 362/311, 375, 339, 338, 335, 333; 350/409, 420, 167

[56] References Cited

U.S. PATENT DOCUMENTS

| | | | |
|---|---|---|---|
| 3,368,078 | 2/1968 | Flint et al. | 350/409 X |
| 4,158,222 | 6/1979 | Cook | 362/269 |
| 4,520,434 | 5/1985 | Birt | 362/335 X |
| 4,542,448 | 9/1985 | Yamai et al. | 362/339 X |

*Primary Examiner*—John F. Terapane
*Assistant Examiner*—John S. Maples
*Attorney, Agent, or Firm*—Finnegan, Henderson, Farabow, Garrett & Dunner

[57] ABSTRACT

A lamp assembly having the lamp housing for containing a bulb and with an opening, optical elements installed in the housing in such a manner as to convert the light from the bulb into parallel rays of light, a condenser lens installed in the opening of the housing for converting the parallel rays of light into beams, the condenser lens being provided with a plurality of convex surfaces on the side facing to the optical elements and a plurality of concave surfaces on the opposite side of it corresponding to the convex surfaces, slit plate having portions pervious to light installed in the opening, the improvement comprising that both focuses of the convex surface and the concave surface are settled in such a manner that they are placed on the same point on the center line of the portion pervious to light of the slit plate.

1 Claim, 3 Drawing Figures

LAMP ASSEMBLY

This is a continuation of application Ser. No. 573,655, filed Jan. 25, 1984, now abandoned.

BACKGROUND OF THE INVENTION

This invention relates to an improved lamp for use in vehicles and beacon lights and so forth. The conventional lamp for use as beacon lights or for illumination, especially in vehicles is shown in FIG. 1 and comprises a housing containing a bulb, an inner lens having so-called frenel lens which converts the light radiated from the bulb into parallel rays of light, and a condenser lens consisting of a plurality of convex lenses on the surface facing the bulb. The condenser lens condenses the parallel rays of light into a plurality of beams, so as to make the beams pass through the light pervious portions which are disposed on an outer lens, as shown in FIG. 1. In the conventional illumination lamp, it is generally required to radiate the light as far as possible without causing its luminous intensity to be weakened, and for this purpose there have been many kinds of improvements. However, when the light emitted by the bulb is converted into parallel rays of light and the parallel rays of light are condensed at the focal point between a condenser lens 1 and a slit 2 as shown in FIG. 1, the diffusion of the light will become greater as it goes away from the focal point, weakening the luminous intensity. The disadvantage is that the light is unable to be seen from a distance. Moreover, if the lamp is thus constructed, the light emitted by the bulb will not be emitted out of the slit 2 at 100% effectiveness unless the location of the slit 2 is arranged at a point which corresponds to the focal point of the condenser lens 1.

SUMMARY OF THE INVENTION

An object of the present invention which has been made in the light of the above described problems is to define the construction of a lamp capable of radiating the light emitted by a bulb as far as possible without causing the light to be extremely weakened and emitting the light radiated thereby at 100% effectiveness through a slit irrespective of the location of the slit.

More specifically, a lamp assembly according to the present comprises a lamp housing containing a bulb and an opening, optical elements i.e. frenel lens, installed in the opening of the housing in such a manner as to convert the light from the bulb into parallel rays of light, a condenser lens installed in the opening of the housing for converting the parallel rays of light into beams, the condenser lens being provided with a plurality of convex surfaces on the side facing to the frenel lens and a plurality of concave surfaces on the opposite side of the condenser lens corresponding to the convex surfaces, and a slit plate having portions pervious to light installed in the opening. According to the present invention both focuses of the convex surface and the concave surface are placed on the same point on the center line of the portion pervious to light of the slit plate.

The condenser lens is arranged in such a manner that both focuses of the convex surface and the concave surface are placed on the same point on the center line of the portion of the slit plate.

BRIEF DESCRIPTION OF THE DRAWINGS

An embodiment of the present invention will now be described, by way of example and with reference to the accompanying drawings in which.

DETAILED DESCRIPTION OF THE INVENTION

Figure 1:
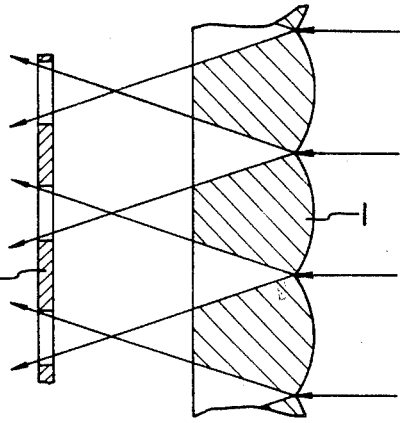
FIG. 1 PRIOR ART
FIG. 1 is a cross-sectional view illustrating the principal part of the construction of a conventional lamp.
Figure 2:
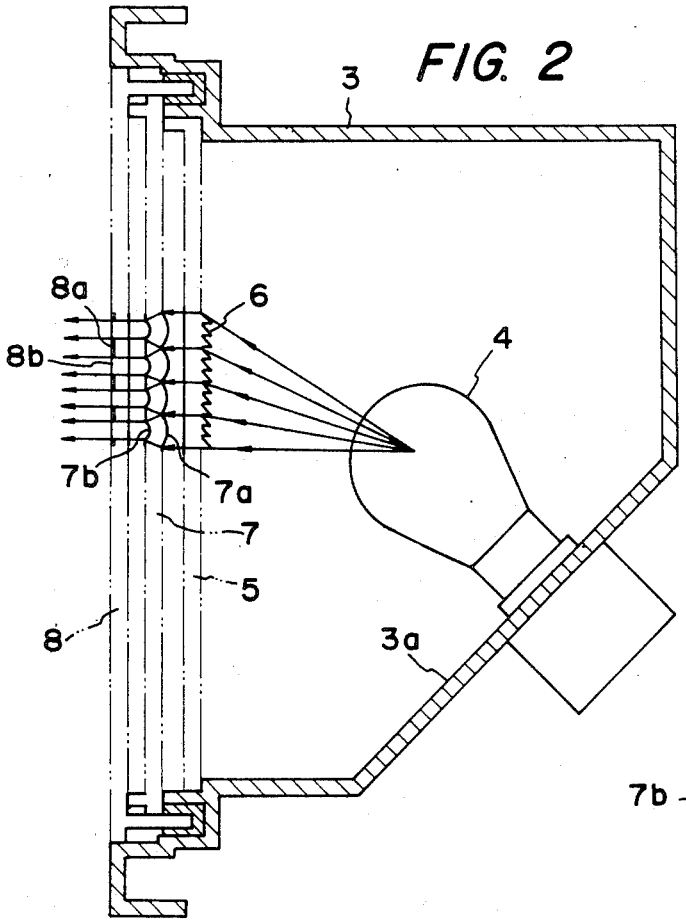
FIG. 2 is a cross-sectional view illustrating a preferred embodiment of the present invention.
Figure 3:
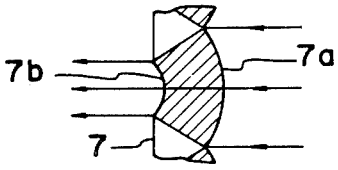
FIG. 3 is a cross-sectional view illustrating the principal part of the condenser lens shown in FIG. 2.

Referring to FIG. 2, a preferred embodiment of the present invention will be described. Numeral 3 indicates lamp housing and there is installed a bulb 4 in the upwardly inclined surface 3*a* on the bottom side of the housing 3. An inner lens 5 is fixed in the opening of the housing 3, the lens being used as an optical element for converting the light from the bulb into parallel rays of light. On the surface of the inner lens 5 facing the bulb 4, there are formed a number of prisms, such as a frenel lens, for converting the light from the bulb into parallel rays of light. Also in the housing, a condenser lens for converting the parallel light rays of light into beams is installed. On the surface of the condenser lens facing to the inner lens there are formed a number of convex surfaces 7*a* as shown in FIG. 3. On the opposite side corresponding to convex surfaces there are formed a number of concave surfaces 7*b*. Further an outer lens 8 is installed facing and parallel to the condenser lens. On the surface facing to the concave surfaces there are formed portions pervious to light corresponding to each convex surface respectively. The remaining surfaces 8*a* except the portions 8*b* pervious to light of the outer lens are all coated in color.

The principal feature of the present invention resides in the fact that the focus of the convex surface of the condenser lens and the focus of the concave surface are placed on the same point on the center line of each portion pervious to light which corresponds to the radiating direction of the beam. By this construction the beam emitted from the concave surface can go through without being interrupted by the coated surface, further because this beam is formed by a plurality of parallel rays of light, the light is able to be seen from a distance.

Moreover in this lamp assembly, when at least one of the portions pervious to light, i.e., either the condenser lens or the inner lens is colored, a colored illumination light may be obtained and such an optical element for that purpose as a paraboloidal reflex mirror may be installed on the bottom side of the housing 1 instead.

What is claimed is:

1. A lamp assembly comprising:

a housing having an opening;

a bulb for emitting light mounted within said housing;

optical element means positioned within said opening of said housing for converting the light from said bulb into parallel rays;

a condenser lens aligned within said opening adjacent said optical element means and including complementary pairs of concave and convex surfaces on opposing sides of said condenser lens, said convex surfaces being positioned on the side adjacent said optical element means, each of said concave and convex surfaces having a common optical axis, wherein each of said pairs of concave and convex surfaces is individually focused at the same point on said common optical axis, each of said pairs of concave and convex surfaces condensing said rays to produce a beam having a plurality of individual parallel rays, said beam having a cross-section corresponding to said concave surface; and an outer lens having a plurality of light transmitting portions and light restrictive portions and positioned within said opening adjacent said concave lens, each of said light transmitting portions being aligned with one of said pairs of concave and convex surfaces, for receiving and directing said beam out of said housing.

* * * * *